US005531034A

United States Patent [19]

Mentz

[11] Patent Number: 5,531,034

[45] Date of Patent: Jul. 2, 1996

[54] HORIZONTAL DRYER HAVING A SCREW CONVEYOR AND RING ELECTRICAL HEATING ELEMENTS

[76] Inventor: James W. Mentz, 306 Hawthorne Dr., Wilmington, Del. 19802

[21] Appl. No.: 431,486

[22] Filed: Apr. 28, 1995

[51] Int. Cl.[6] ..... F26B 11/12

[52] U.S. Cl. ..... 34/179; 34/182; 219/388

[58] Field of Search ..... 34/179, 182, 183; 219/388

[56] References Cited

U.S. PATENT DOCUMENTS 3,217,427 11/1965 Wright ..... 34/135
4,430,057 2/1984 Hoover et al. ..... 34/179
4,453,319 6/1984 Morris ..... 34/183
5,016,566 5/1991 Levchenko et al. ..... 34/388
5,253,266 10/1993 Knodle, III et al. ..... 34/388

*Primary Examiner*—John T. Kwon
*Attorney, Agent, or Firm*—Breneman, Georges & Krikelis

[57] ABSTRACT

A continuous dryer for minerals and ores which employs a single horizontal screw conveyor in a cylindrical drying chamber with a plurality of external electrical heating elements surrounding the drying chamber. The screw conveyor has cut and folded flights which extend to within less than about one quarter inch from the inside wall of the drying chamber. The heating elements have integral mineral insulation, completely surround the drying chamber, and are in intimate contact with the chamber outer wall.

5 Claims, 2 Drawing Sheets

HORIZONTAL DRYER HAVING A SCREW CONVEYOR AND RING ELECTRICAL HEATING ELEMENTS

BACKGROUND OF THE INVENTION

1. Field of the Invention

This invention relates to a dryer for granular solid materials and more particular to a continuous dryer for minerals and ores which employs a single screw transport in a drying chamber with a plurality of external electrical heating elements surrounding the drying chamber.

2. Description of Related Art

As used in this invention the term "solids" will mean any solid broken up material, including but not limited to, coarse to very fine granular material such as sand of different textures, ores and minerals. The term "wet solids" will be used to indicate a mixture of solids with a volatile fluid, which may be but is not necessary limited to water, wherein the solids are not in solution in said fluid to any appreciable extend.

Dryers for removing a fluid from wet solids through the application of heat are well known in the art. Such dryers may be classified in two broad categories, batch dryers and continuous dryers. Batch dryers are dryers which comprise a drying chamber which is loaded with the wet solids, and the solids are heated in the chamber for a time sufficient to remove the volatile fluid therefrom, after which time the chamber is emptied and the process is repeated with a new load.

Continuous dryers on the other hand, as the name implies, operate by transporting in a continuous manner the solids to be dried through a drying zone. Fresh, wet solids are constantly added at one point in the dryer and dry material removed at another. In between, the solids are conveyed through a drying zone where heat is applied to remove the volatile fluids therefrom.

Continuous dryers require means to transport the wet solids through the drying zone. Screw conveyors are one known such means. To dry the material, screw conveyors may transport the material in contact with a current of a flowing heated medium, typically heated air. The flow of the heated medium may be in the direction of the transport of the solids, or against it. Such arrangement, while efficient in removing a volatile fluid from the drying material, is disadvantageous when used for drying fine solids, because the flowing heated medium produces a substantial amount of dust particles which must usually be contained and removed from the environment.

In an effort to prevent this problem it is known to use a hollow conveyor screw and pass the heating medium through the body of the conveying screw thereby heating the transported material without contacting the material and thus minimizing the dust generation. In both instances however there remains the problem of efficiently heating the ore or mineral in a more or less uniform manner in order to completely dry all of the material. It has been the experience of the art practitioners that wet ores, minerals and other such granular materials tend to agglomerate and compact during transport particularly when screw conveyors are used, producing agglomerations of material which is not completely dry. In addition, solids tend to stick and form a cake on the shaft and flights of the conveyor screws and on the inner wall of the dryer, reducing heat transfer efficiency.

Another problem encountered in continuous dryers particularly where the heating fluid is directed through the screw transport body, relates to the bearings supporting the screw which are subjected to high heat, requiring the use of special materials both for the bearings and for the lubricant used in the bearings.

U.S. Pat. No. 4,430,057 teaches a dryer for driving volatile substances from materials in a horizontal drying chamber which appears to address some of the prior art problems. To avoid the agglomeration problem, this reference teaches the use of a screw conveyor wherein the screw flights incorporate scrapers and lifters. A plurality of parallel, interacting, screw conveyors is suggested for optimum efficiency. Heat is applied externally of the drying chamber using a plurality of fuel burners to heat the upper portion of the drying chamber. The screw conveyor is located at the bottom end of the drying chamber and the agitating paddles on the conveyor serve to constantly bring fresh material to the upper, hotter side of the chamber while transporting the solids from an input end of the dryer chamber to the other. During drying and transport the treated material remains at the lower part of the heating chamber.

While this dryer structure represents an improvement over prior dryers, there remains the problem of dust generation in the space above the conveyor screw as a result of the agitation. This dust is not only a nuisance, but can be dangerous when pyrotechnic or heat sensitive ores are processed, because of the presence of the open flame used to heat the drying chamber. Further more, in the disclosed structure heat is applied to the ore primarily by radiation from above, supplemented with any incidental convection at the lower, unheated portion of the drying chamber, the only place where the ore is in contact with the chamber wall. Finally, the multiplicity of conveyor screws specially designed to interact in agitating the ore results in a dryer that is complex and expensive to produce.

Thus there is still need for a safe, simple, continuous dryer which offers high heating efficiency, avoids agglomeration, caking and compacting problems, produces a minimum amount of dust and is safe and cheap to manufacture and operate.

These and other objects of the present invention will be clear from the following description.

SUMMARY OF THE INVENTION

This invention is for a dryer for solid materials which comprises:

A substantially horizontal elongated hollow cylindrical drying chamber having a first end and a second end;

an inlet chamber located at the first end of the drying chamber having an inlet port;

an outlet chamber located at the second end of the drying chamber having a vent port and a solids discharge port; and a single screw conveyor within said drying chamber, coaxial and coextensive therewith. The screw conveyor comprises a shaft with flights extending from the shaft to within less than one quarter inch from an inner wall of the drying chamber. The flights further include cut and folded flight portions.

A motor drive is mounted outside the inlet chamber and drives the single screw.

A plurality of mineral insulated electric ring heating elements are located in intimate contact with the outer surface of the drying chamber, each substantially surrounding the drying chamber. The heating elements are distributed at substantially equal distances axially along the drying chamber.

A power distributor comprising an external power source connector and at least one electrical conductor connecting it to the heating elements for applying electrical energy from an outside source to the heating elements is provided. A temperature sensor in contact with the outer surface of the drying chamber and connected to the power distributor permits controlling the application of electrical energy to the heating elements.

BRIEF DESCRIPTION OF THE DRAWINGS

The invention can be more fully understood from the following description thereof in connection with the accompanying drawings described as follows.

DESCRIPTION OF THE PREFERRED EMBODIMENT(S)

Figure 1:
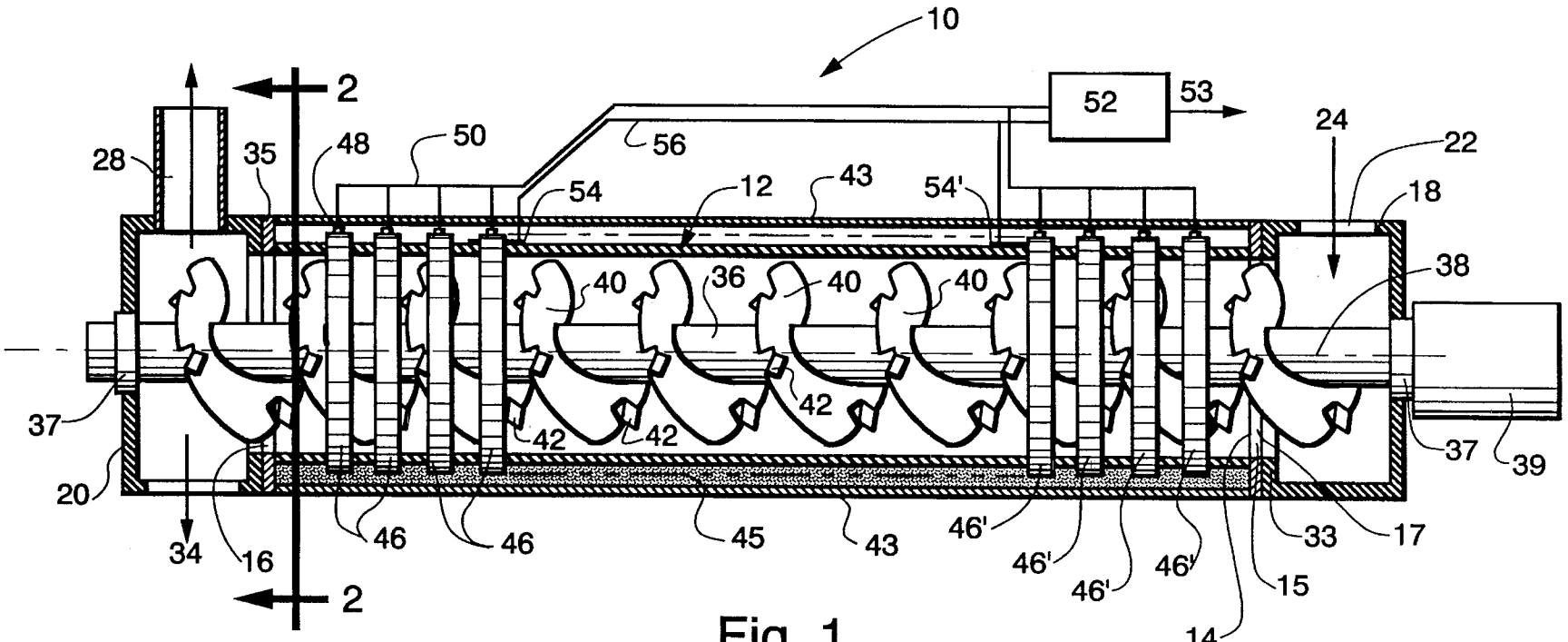
FIG. 1 is a schematic representation of an elevation view of a dryer in accordance with the present invention.

Throughout the following detailed description, similar reference characters refer to similar elements in all figures of the drawings.

Referring now to FIG. 1 there is depicted in schematic representation an embodiment of a dryer 10 built in accordance with the present invention. The dryer comprises a horizontal, cylindrical drying chamber 12 which has an axis 38 extending therethrough. To provide good heat conductivity at low cost, the drying chamber is usually constructed of carbon steel. When there is need for drying temperatures in excess of 1250° F. stainless steel may be substituted. On the other hand if the need for high temperatures is absent, Aluminum, Copper, or other materials may be selected which provide good heat conductivity or resistance to oxidation, or lower manufacturing costs.

At one, first end of the cylindrical chamber there is a first opening which forms an entrance 14 to the drying chamber. At another, second end of the cylindrical chamber there is a second opening 16 which forms an exit end of the drying chamber. A plate 33 is attached to the first end of the drying chamber to form a flange which supports an inlet chamber 18 mounted. Preferably the plate 33 is generally square in shape and is welded onto the drying chamber. Plate 33 includes an opening 15 of the same size as entrance 14 to the drying chamber. Inlet chamber 18 is attached to plate 33 with bolts to permit easy demounting for cleaning. A wall of inlet chamber 18 adjacent the drying chamber includes an opening 17 which is at least as large as opening 15 so as not to obstruct the entrance 14 to the drying chamber.

Inlet chamber 18 further includes an inlet port 22 which allows wet solids represented by arrow 24 to be introduced into the inlet chamber 18.

At the second end of the drying chamber there is mounted a plate 35 which has similar structure and function as plate 33 and on which there is attached again with bolts for the same reasons as herein above stated, an outlet chamber 20. Chamber 20 and plate 35 also include openings dimensioned so as not to obstruct the exit of the drying chamber 12. Outlet chamber 20 includes at a bottom wall, a discharge port 34 for discharging through gravity dry solids exiting the dryer, and a vent port 28 for discharging steam or other vapors generated during the drying of the wet solids in the drying chamber.

Extending throughout the dryer 10 coaxial with the axis 38 is a screw conveyor having a shaft 36 and screw flights 40. The shaft 36 extends outside both the inlet and outlet chambers, and is mounted thereon with bearings 37. Located preferably at the inlet chamber side, is motor drive 39 which drives the screw conveyor. The details of the drive are not depicted in this figure since the particulars of the drive are neither essential or novel. The drive may comprise an electric motor directly coupled to the screw shaft 36, preferably a motor that permits varying the rotation rate of the screw drive. The drive may also be mounted adjacent the body of the dryer, and be connected to the shaft 36 through a driving chain and sprocket arrangement.

The flights 40 of the screw drive extend the full length of the drying chamber. Preferably the flights continue at least partly into the inlet chamber.

Figure 3:
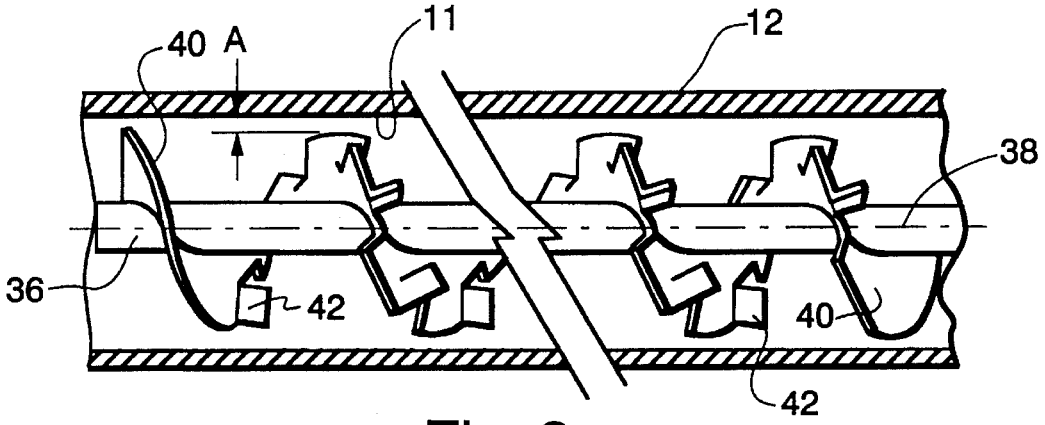
FIG. 3 is a schematic representation of a portion of the conveyor screw in the drying chamber.

The flights 40 of the screw drive as better shown in FIG. 3 extend radially from the shaft 36 to a distance "A" from the inner wall of the drying chamber 12, which is equal to or less than about one quarter of an inch (6.35 mm).

The screw flights 40 include cut and folded portions 42 which serve to agitate the solids conveyed by the screw conveyor. In the preferred embodiment, a conveyor screw with cut and folded flights made by the Conveyor Equipment Division of FMC Corporation of Tupelo, Miss. used, however a cut flight conveyor screw with paddles could also be used, since both types provide agitation and aeration. The preferred type which has cut and folded flights provides not only agitation and aeration but also a cascading effect which increases the efficiency of the dryer.

Figure 2:
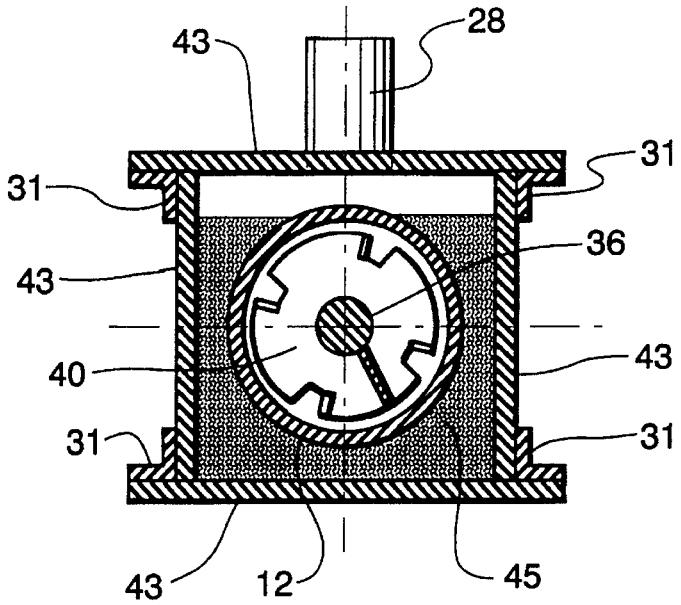
FIG. 2 is a schematic sectional representation of a view of the dryer shown in FIG. 1, taken along line 2—2.

The drying chamber is surrounded by four walls 43 better shown in FIG. 2. Angular braces 31 are used to support the walls and form a casing around the dryer chamber 12. Preferably the walls 43 are insulating walls which help reduce the heat loss to the outside of the dryer. An high temperature insulating material 45 is used to fill the void between the walls 43 and the outer wall of the chamber 12 almost completely, leaving an open space at the upper part of the casing for easy access to the wiring 50 and the electrical connections 48 to heating elements 46, 46'.

Figure 4:
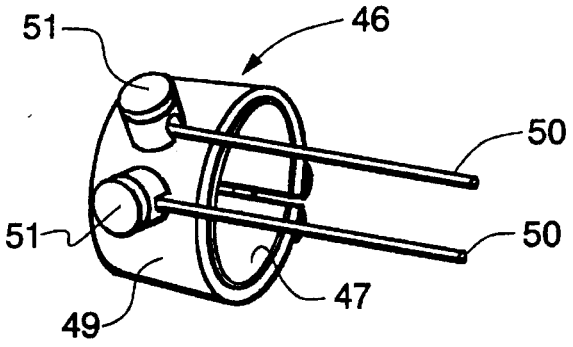
FIG. 4 is a schematic representation of a mineral insulated ring heater element used in this invention.

Surrounding the drying chamber and in intimate contact with its outer surface are a plurality of mineral insulated ring shaped electrical heating elements of the type shown in FIG. 4. As shown in that figure, the elements have a resistive heater portion 49 and a mineral insulating layer 47 which provides electrical insulation while it maintains good heat transmission. Connectors 51 are provided for connecting an electrical conductor 50 to apply electrical power to the resistive heater portion 49 of the heating element 46. Because of the presence of the electrical insulating layer 47 the elements can be brought into intimate contact with the outer surface of the chamber 12 and provide excellent heat transfer from the electrical conducting heating portion of the heater element to the chamber walls without concerns about shorting the elements.

The heating elements are axially distributed along the drying chamber body preferably equidistant. A power distribution system schematically shown as wiring 50 connects the heating elements to a power controller 52 which serves to connect the system to an outside power source 53. The power controller 52 may comprise circuitry to apply power to the heating elements individually, or the elements may be grouped together in a plurality of banks as shown in FIG. 1.

Thermocouples 54, 54' etc. may be used, placed under the heating elements in contact with the outer surface of the chamber 12, connected through wire 56 to the power controller 52. The thermocouple output can be used to regulate the power applied to the heating elements and to provide a desired temperature profile along the axis 38 of the drying chamber 12.

In operation, a drying temperature is first decided upon. Such temperature is usually selected empirically based on prior experience with the particular ore to be dried. The controller 52 is set to apply power to the heating elements and to maintain the temperature to the desired selected level by monitoring the output indication of the thermocouples, applying and interrupting power to the different heating elements so as to maintain a uniform temperature profile along the drying chamber. A temperature indicator connected to the thermocouple output may be provided to supply a visual indication of the temperature of the drying chamber outer surface. (A non uniform temperature profile may also be maintained, if desired.)

After the temperature has reached the desired level and the system is in its steady state, wet solids are introduced in a continuous fashion through inlet port 22 into inlet chamber 18 where they are picked up by the rotating flights 40 of the screw conveyor. The wet solids are transported through the drying chamber at a rate determined by the speed of rotation of the conveyor. Information provided by the manufacturer of screw conveyors permits calculating the transit time of solids transported through a particular screw conveyor as a function of the conveyor length, flight shape and spacing, and the speed of rotation of the screw.

If this information is not available, the transit time may be easily determined experimentally by measuring the time it takes for material first introduced into the drying chamber to first exit the chamber while the screw rotation is maintained constant. By varying the rotation speed and measuring the elapsed time of transit of ore a number of times, one may construct a curve showing transit time as a function of rotation, and use this relationship to extrapolate rotation speed for any wanted transit time.

The selection of the conveyor screw with cut and folded flights reaching to within less than a quarter inch (6.35 mm) from the inner wall of the drying chamber results in the solids being heated by contact with the hot wall of the chamber continuously, at the top sides and bottom of the chamber. At the same time the wall radiates heat which is also applied to the solids as the agitating and aerating folded portions 42 agitate and cascade or tumble the solids as they advance in the chamber. Thus both convection and radiation heating is applied to the solids throughout the full 360° rotation during transport.

Input material generally tends to fill the input chamber blocking any substantial back-flow of steam or other volatiles from escaping through the input end. Steam or other volatiles removed from the solids during heating are evacuated through the venting port 28 in the direction of the arrow. It appears that the close tolerance between the screw conveyor flights which tends to restrict the passage available between the flights and the inner wall of the chamber results in the almost total absence of caked material or solids build up on the inner chamber wall as is typical of this type of dryers, such caking or build up of material on the wall possibly being scraped by the moving solids or the action of the steam traveling towards the exit opening, or both.

The dried solids exit the heating chamber and fall through gravity out of the outlet chamber to an appropriate container.

The described arrangement of components has the added beneficial effect that the bearings supporting the conveyor screw can be located at relative cool portions of the dryer. The preferred location for the driving system is shown to be on the outside of the inlet chamber which is the coolest part of the dryer. The driving system can of course be mounted on the outside of the chamber far wall, i.e. the wall opposite the exit of the heating chamber, without changing the scope of this invention, since the outlet chamber far wall is also substantially cooler than the rest of the dryer. Placing the drive in the coolest possible location on the dryer, presents advantages in terms of durability and ease of maintenance of the components of the drive. The use of a single screw limits the number of components and simplifies construction and cost of this equipment. The application of heat from all sides of the chamber greatly improves the efficiency of the drying process.

The dryer described above was used to dry Zirconium sand, a natural mineral, wetted with sea water, and having residual water content of about 5% by weight. The dryer was heated to a uniform longitudinal temperature of 550° F. using a single bank of 20 ring heating elements each 1.5 inches (3.81 cm.) wide, evenly spaced along a 5 ft. (1.52 m) long drying chamber requiring a total of 25 KW (Kilowatts) of electrical power. The heating elements are MI-Band Heaters (Mineral Insulated) manufactured by Watlow Electrical Manufacturing Co. of St. Louis Mo. The conveyor screw was a screw with cut and folded flights made by Thomas Conveyor Co. of Fort Worth Tex., Model Number FO-6HS304R having 2 flights per foot. The flights reached to about 3/16 inches (0.476 cm) from the inside wall of the drying chamber. The rotation rate was set at 0.75 RPM ( Revolutions per minute) resulting in product residence time in the dryer of about 5 minutes. The output sand was free of any measurable moisture and was discharged at a temperature of about 300° F.

The same material was next soaked in fresh water and removed therefrom with a moisture content of over 20% by weight. The same dryer as before was again used to dry this ore, with the only change being that the heating element temperature set at 700° F. rather than 550° F. The discharged dry sand was at a temperature of about 532° F. and again contained no detectable moisture. No caking of material on the dryer walls or screw flights was observed, and the dried sand did not contain any agglomerations but was completely free flowing.

The apparatus has been described heretofore as having a single temperature control. However as shown in FIG. 1, the heating elements may be connected into groups of elements which are controlled independently, i.e. group of elements 46 and group of elements 46' may be at different set temperatures to provide a desired temperature profile along the chamber axis 38. In the final analysis a thermocouple may be associated with each of the ring heating elements, inserted between the element and the chamber wall and secured thereunder by the element itself, to provide very fine longitudinal temperature adjustment.

Those skilled in the art having the benefit of the teachings of the present invention as hereinabove set forth, can effect numerous modifications thereto. These modifications are to be construed as being encompassed within the scope of the present invention as set forth in the appended claims.

I claim:

1. A dryer for wet solids comprising:

a substantially horizontal elongated hollow cylindrical drying chamber having an axis, a first end and a second end;

an inlet chamber located at the first end of the drying chamber the inlet chamber having an inlet port;

an outlet chamber located at the second end of the drying chamber the outlet chamber comprising a vent port and a discharge port;

a single screw conveyor within said drying chamber, said screw conveyor also having an axis said axis being coaxial with the chamber axis, said screw conveyor comprising a shaft with flights extending from said shaft, the flights having cut and folded flight portions, said flights extending to within less than one quarter inch from an inner wall of said drying chamber;

a motor drive for driving said single screw;

a plurality of mineral insulated electric ring heating elements located in intimate contact with an outer surface of said drying chamber each substantially surrounding said drying chamber, the heating elements being distributed at substantially equal distances axially along substantially the entire drying chamber;

a power distributor comprising an external power source connector and at least one electrical conductor connected to said heating elements and said power distributor for applying electrical energy to said heating elements; and a temperature sensor in contact with the outer surface of the drying chamber and connected to said power distributor.

2. The dryer of claim 1 wherein the screw flights extend at least partially into the inlet chamber and the screw has a shaft which extends outside the inlet chamber and which shaft is connected to the motor drive.

3. The dryer according to claim 1 wherein the drying chamber includes external heat insulation covering said ring electrical heating elements.

4. The dryer according to claim 1 wherein the power distributor is connected through separate electrical conductors to individual ring electrical heating elements of said plurality of heating elements.

5. The dryer according to claim 4 wherein there are more than one temperature sensors in contact with the dryer chamber and wherein the sensors are used to selectively control the energy applied to said heating elements through the power distributor to produce an axially oriented temperature profile along the dryer chamber.

* * * * *